United States Patent [19]

Beeks et al.

[11] 4,264,457

[45] Apr. 28, 1981

[54] CATIONIC LIQUID LAUNDRY DETERGENT AND FABRIC SOFTENER

[75] Inventors: Michael J. Beeks, Villa Park; Allen J. Wysocki, Arlington Hgts, both of Ill.

[73] Assignee: DeSoto, Inc., Des Plaines, Ill.

[21] Appl. No.: 118,591

[22] Filed: Feb. 4, 1980

[51] Int. Cl.[3] ..... D06M 13/32; D06M 13/46; C11D 1/86; C11D 17/08

[52] U.S. Cl. ..... 252/8.75; 252/8.7; 252/8.8; 252/8.9; 252/173; 252/174.21; 252/174.22; 252/528; 252/531; 252/532; 252/547; 252/548; 252/550; 252/551; 252/DIG. 14

[58] Field of Search ..... 252/8.7, 8.75, 8.8, 252/8.9, 173, 174.21, 174.22, 528, 547, DIG. 14, 531, 532, 550, 551

[56] References Cited

U.S. PATENT DOCUMENTS

| | | | |
|---|---|---|---|
| 3,003,954 | 10/1961 | Brown | 252/8.8 |
| 3,296,145 | 1/1967 | Findlan | 252/106 |
| 3,351,483 | 11/1967 | Miner | 8/137 |
| 3,505,221 | 4/1970 | Waldman | 252/8.75 |
| 3,644,203 | 2/1972 | Lamberti | 252/8.75 |
| 3,741,911 | 6/1973 | Shane | 252/527 |
| 3,951,879 | 4/1976 | Wixon | 252/547 |
| 3,997,453 | 12/1976 | Wixon | 252/8.75 |
| 4,058,489 | 11/1977 | Hellsten | 252/547 |
| 4,102,825 | 7/1978 | Murata | 252/547 |
| 4,130,497 | 12/1978 | Oneto | 252/132 |

FOREIGN PATENT DOCUMENTS

| | | | |
|---|---|---|---|
| 818419 | 7/1969 | Canada | 252/8.75 |
| 873214 | 7/1961 | United Kingdom | 252/8.75 |

*Primary Examiner*—Dennis L. Albrecht

*Attorney, Agent, or Firm*—Dressler, Goldsmith, Shore, Sutker & Milnamow, Ltd.

[57] ABSTRACT

A cationic liquid laundry detergent for softening fabrics and giving them antistatic properties is disclosed which contains about 3–35% by weight nonionic surfactant formed by reacting about 5–200 moles of ethylene oxide with a hydrophobic organic compound having 8–50 carbons, about 3–30% by weight mono-long chain cationic surfactant selected from 2 groups of surfactants or mixtures thereof, and water soluble anionic surfactants selected from a mixture of $C_4$–$C_{10}$ alcohol sulfates and $C_{12}$–$C_{22}$ alcohol ethoxylated ether sulfates or carboxylates. The anionic surfactants are present at a mole ratio, one to the other, of about 1:5 to about 5:1 and the mole ratio of cationic surfactant to anionic surfactant is about 0.8:1 to about 10:1.

16 Claims, No Drawings

CATIONIC LIQUID LAUNDRY DETERGENT AND FABRIC SOFTENER

DESCRIPTION

1. Technical Field

This invention relates to the provision of cationic liquid laundry detergent compositions which provide fabric softening and antistatic characteristics while maintaining good detergency.

2. Background Art

Numerous efforts have been made to provide a laundry detergent which will soften the fabrics being washed and render them resistant to the retention of static charges. However, the cationic materials previously used for softening and antistatic effects usually function to reduce detergency, and it has not been possible to simultaneously achieve good results in both directions.

Some progress in this direction is made in Hellsten U.S. Pat. No. 4,058,489 issued Nov. 15, 1977, wherein use of nonionic, cationic and anionic surfactants is taught. This patent relies upon the use of di-long chain aliphatic quaternary ammonium compounds and a charge ratio of anionic surfactant to cationic surfactant within the range of about 0.60 to about 0.98. These teachings may be appropriate for products in the form of solid laundry detergents, as are primarily taught therein. However, in attempting to provide stable liquid laundry detergents having the combination of characteristics presently under consideration, we have found that di-long chain aliphatic quaternary ammonium compounds lead to liquids having unsatisfactory soil removal capacity, and softening and antistatic characteristics are also poor.

Canadian Pat. No. 818,419 issued July 22, 1969 to Urfer et al. discloses textile softener-detergent compositions containing an electro-neutral cationic-anionic surfactant complex which is dispersed by a mixture of nonionic and cationic materials. These compositions are disclosed principally as solid detergent compositions which will disperse and maintain the dispersion in an aqueous medium. Liquid compositions are said to be prepared by dispersing the active ingredients in water, lower alkyl alcohols or aromatic solvents such as benzene and toluene.

The anionic surfactants of Canadian Pat. No. 818,419 are stated as being any anionic surfactant capable of complexing with a cationic textile softener to form an electrically neutral complex. These surfactants include any alkali metal salt of an organic sulfuric reaction product of an alkyl or aryl radical having about 8–18 carbon atoms in its structure, alone or in combination with an aryl radical having at least 6 carbon atoms and sulfonic or sulfuric acid ester radical. The preferred cationic surfactants are stated as being those quaternary nitrogen compounds having two $C_{12}$–$C_{18}$ alkyl groups and two methyl groups.

A liquid composition was prepared attempting to follow the disclosure of this Canadian patent and was found to be unstable in that a precipitate formed which is not surprising since the formation of a water insoluble precipitate is indicated to normally result at page 3 of the patent. A precipitate-containing aqueous detergent is unsatisfactory for this reason alone. Solid and liquid compositions according to this patent were prepared and found to have poorer washing properties than the compositions disclosed hereinafter.

British Pat. No. 873,214 to Brunt et al., whose complete specification was published July 19, 1961, discloses textile detergent compositions in solid and aqueous liquid forms with antistatic properties which contain 51–98.5% by weight nonionic surface active agents, 1–48.5% by weight cationic surface active agents and anionic surface active agents present at 0.5–24% by weight, all based on the total weight of surface active agents; the cationic surface active agent being present in stoichiometric excess over the anionic surface active agent. A number of specific surfactants of each of the above classes are listed in this patent, and it is stated therein that a plurality of any or each of the surface active agents may be used. This prior disclosure does not specifically suggest the selection of components and the proportions thereof which have been found, in this invention, to provide superior results as illustrated hereinafter.

DISCLOSURE OF INVENTION

In accordance with this invention, a cationic liquid laundry detergent composition adapted to soften fabrics and render them antistatic while maintaining good detergency is provided by combining the following specific three classes of components in critical proportions to provide a composition comprising:

(A) about 3–35% by weight of a nonionic surfactant formed from reacting ethylene oxide and a hydrophobic organic compound containing from about 8 to about 50 carbon atoms, the nonionic surfactant containing from about 5 to about 200 moles of ethylene oxide per mole of the hydrophobe;

(B) about 3–30% mono-long chain cationic surfactant selected from surfactants 1, 2 and mixtures thereof, wherein surfactant 1 has the formula:

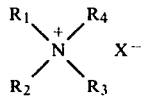

1 wherein $R_1$ is a long chain aliphatic radical having about 8–22 carbon atoms, $R_3$ and $R_4$ are $C_1$–$C_4$ alkyl (preferably methyl), $R_2$ is $C_1$–$C_4$ alkyl, benzyl or phenyl, and $X^-$ is an anion; and surfactant 2 has the formula:

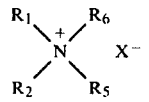

2 wherein $R_1$, $R_2$ and $X^-$ are the same as set forth above,

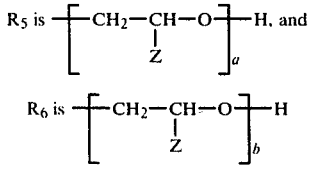

wherein a and b have an average value of at least about 1, a+b is about 2–50, and Z is hydrogen or methyl. The selection of mono-long chain cationic surfactants is critical herein since the di-long chain materials do not function properly. Each of the cationic surfactants 1 and 2 may be present alone in the composition, but preferably both surfactants are present in a mole ratio, one to the other, in the order listed, of about 1:2 to about 8:1, and most preferably at a mole ratio of about 1:1 to about 5:1; and (C) anionic surfactants consisting essentially of a mixture of water soluble surfactants 3 and 4, wherein surfactant 3 is a $C_4$–$C_{10}$ alcohol sulfate, and surfactant 4 is selected from $C_{12}$–$C_{22}$ alcohol ethoxylated ether sulfates or carboxylates having about 1–15 moles of ethylene oxide per molecule. The anionic surfactants may be present at a mole ratio, one to the other, of about 1:5 to about 5:1, and preferably at a ratio of about 1:1.5 to about 1.5:1. These two anionic surfactants must be present in admixture with one another in the mole ratios described in order to obtain the superior performance which characterizes this invention, so these ratios are critical herein.

The mole ratio of total cationic surfactant to total anionic surfactant can vary greatly from 0.8:1 to about 10:1. The cleaning, antistatic and softening actions are best obtained in the presence of a molar excess of cationic surfactant. The total cationic-anionic surfactant mole ratio in the composition is preferably in the range of about 1.1:1 to about 5:1.

The range of ratios disclosed in said U.S. Pat. No. 4,058,489 are operative herein. The patented range of anionic to cationic surfactant mole ratios of 0.6 to 0.98 converts to a cationic to anionic surfactant mole ratio of about 1.67:1 to about 1.02:1 and is thus within the range of useful mole ratios of 0.8:1 to 10:1 taught herein. Best results are obtained herein with a most preferred cationic-anionic surfactant mole ratio of from about 1.4:1 to about 2.5:1. The most preferred range of mole ratios herein thus extends from the high end of the patented range of cationic-anionic surfactant ratios to well above that range. Furthermore, while said patent teaches that washing effectiveness decreases quite rapidly when the cationic-anionic surfactant mole ratio increases above about 1.7:1, we have found this cationic-anionic surfactant mole ratio to provide nearly maximal effectiveness for detergency, softness and anti-static properties in this invention. Moreover, in this invention, the overall efficiency of detergent compositions in the more preferred cationic-anionic surfactant mole ratio of about 1.4:1–2.5:1 is relatively constant.

In addition to the differences in the selection of cationic surface active agents, and the cationic-anionic surfactant mole ratio discussed hereinbefore, the present invention also importantly differs from the prior art as to which anionic surfactants to select and how to use them. In the prior art, many possibilities are presented and there is no requirment that they be used in any special mixture. On the other hand, the range of suitable anionic surfactants useful in the present invention is more limited, and those anionic surfactants selected for use herein are divided into two groups of non-equivalent materials. Furthermore, the two groups of anionic surfactants taught herein are not only not interchangeable, which is contrary to what is taught by the art, but they enable the desired superior laundering results to be obtained only when used in combination and in a specific range of molar ratios, one to the other, as discussed previously in the description of component C.

It is also desired to stress that the detergents of this invention are provided in the form of a liquid which can be expected to be stored for long periods of time prior to sale or use. While the prior art embraces detergent compositions in any desired form, it would appear that very little attention has been directed to the liquids contemplated herein. This conclusion is reached because it has been our experience that when the di-long chain alkyl ammonium salt cationic agents preferred by the art are used in a combination detergent in the form of a liquid, the compositions are not stable, and the systems separate into two phases on storage, rendering them asthetically unacceptable. It is in this liquid environment (about 8–80% by weight surfactant content) that the marked superiority of the mono-long chain alkyl ammonium surfactants has been discovered.

Phase stability in aqueous medium is also important because the compositions of this invention are preferably provided as aqueous liquids. However, anionic and cationic surfactants in combination often tend to produce precipitates in water. The formation of an anionic-cationic precipitate is avoided herein, and lack of such a precipitate in the compositions of this invention is one of this invention's advantages.

Furthermore, while the types of cationic and anionic surfacts utilized in the instant invention have been used in various fabric washing and softening compositions either singly, or in some combinations with themselves or the nonionic surfactants, the particular combination of the four, or, preferably five, ingredients as used herein, is neither taught nor suggested by the art of which we are aware, to produce the superior combination of detergency, antistatic and softening properties of the compositions of this invention.

The nonionic surfactants of the present invention are water soluble materials which are derived from the reaction of a $C_8$–$C_{50}$ hydrophobic organic compound with about 5 to about 200 moles of ethylene oxide. These materials assist in providing general detergency to the compositions insofar as soil removal is concerned and also assist in suspending, or dissolving the cationic-anionic surfactant complex of this invention. The nonionic surfactant may be present at about 3% to about 35% by weight of the total composition and may be comprised of a single surfactant or a mixture of several surfactants. Nonionic surfactants are desirably present in a weight ratio with respect to the cationic surfactants of from 3:1 to about 1:3. These surfactants may be present in the preferred aqueous compositions, which may contain about 8% to about 20% by weight total nonionic, cationic and anionic surfactant, at about 3% to about 10% by weight of the total composition.

The preferred nonionic surfactants are octylphenol and nonylphenol ethoxylates having about 6 to about 100 moles of ethylene oxide per molecule. Examples of useful nonylphenol ethoxylates include polyoxyethylene (8) nonyl phenyl ether, polyoxyethylene (20) nonyl phenyl ether, polyoxyethylene (50) nonyl phenyl ether, polyoxyethylene (100) nonyl phenyl ether, and the like.

Polyoxyethylene (8) nonyl phenyl ether is known in the art by the somewhat less cumbersome name of Nonoxynol-8 as designated in the *CTFA Cosmetic Ingredient Dictionary*, 2nd. ed., published by The Cosmetics, Toiletry and Fragrance Association, Inc., 1977. The *CTFA Dictionary* surfactant names will be used hereinafter, where convenient.

The above-mentioned polyoxyethylene nonyl phenyl ethers may thus be named Nonoxynol-8, -20, -50 and -100, respectively. Two examples of octylphenol ethoxylates are surfactants having an average of about 9 and about 40 ethylene oxide units per molecule, designated as Octoxynol-9 and Octoxynol-40, respectively, in the *CTFA Dictionary.*

Other useful nonionic surfactants include polyethylene glycol ethers of mixed fatty alcohols. These materials may be exemplified by the $C_{11}$–$C_{13}$ fatty alcohols having an average of 7 moles of ethylene oxide per mole of alcohol (Pareth-13-7), the $C_{11}$–$C_{15}$ fatty alcohols having an average of 7 moles of ethylene oxide per mole of alcohol (Pareth-15-7), the $C_{12}$–$C_{15}$ alcohols having an average of 12 moles of ethylene oxide per mole of alcohol (Pareth-25-12) and the $C_{14}$–$C_{15}$ fatty alcohols having an average of 10 moles of ethylene oxide per mole of alcohol (Pareth-45-10).

Additional useful nonionic surfactants include the polyoxyethylene-polyoxypropylene-polyoxyethylene block copolymers known by the *CTFA Dictionary* designation Poloxamer. Examples of useful Poloxamers include Poloxomer-122 and Poloxamer-185, which have an average of 21 propylene oxide units flanked by an average of 5 ethylene oxides, and an average of 30 propylene oxides flanked by an average of 19 ethylene oxide units, respectively.

Another useful group of nonionic surfactants includes the propylenoxylated ethoxylated aliphatic alcohol ethers, having the polyoxypropylene groups between the aliphatic alcohol and polyoxyethylene groups. These surfactants include polyoxypropylene (10) polyoxyethylene (20) cetyl/stearyl ether (PPG-10-Ceteareth-20), polyoxypropylene (9) polyoxyethylene (12) monobutyl ether (PPG-9-Buteth-12), polyoxypropylene (3) polyoxyethylene (11) myristyl ether (PPG-3-Myreth-11), and the like.

The list of cationic surfactants which may be used in accordance with this invention is more circumscribed than that of the nonionic surfactants, and consists only of two groups of mono-long chain aliphatic ammonium surfactants. The surfactants of each group may be used alone, but best results are obtained when surfactants of both groups are used, and this is preferred.

The first group of cationic surfactants has the structure shown hereinbelow and designated as 1:

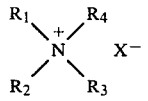

1 wherein $R_1$ is a long chain aliphatic radical having about 8 to about 22 carbon atoms, $R_3$ and $R_4$ are both $C_1$–$C_4$ alkyl (preferably methyl), $R_2$ is $C_1$–$C_4$ alkyl, benzyl or phenyl and $X^-$ is an anion such as a halide, sulfate, methyl sulfate or bisulfate.

Suitable cationic surfactants having the above formula include tallow trimethyl ammonium chloride (Tallow Trimonium Chloride), cetyl dimethyl benzyl ammonium chloride (Cetalkonium Chloride), coco trimethyl ammonium bisulfate (Cocotrimonium Bisulfate), cetyl dimethyl ethyl ammonium bromide (Quaternium-17), and the like. Tallow trimethyl ammonium chloride is particularly preferred.

The second class of cationic surfactants has the structure shown hereinbelow as 2:

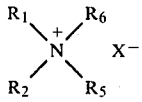

2 wherein $R_1$, $R_2$ and X are the same as set forth above,

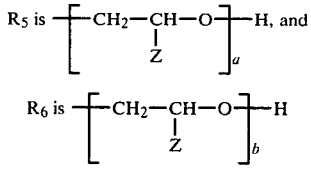

wherein a and b have an average value of at least about 1, a+b is about 2–50, and Z is hydrogen or methyl. Commercial materials may contain a diverse mixture in which the actual values of a and b are variable.

Suitable surfactants for this class of cationic surfactant include N-ethyl N-cocoammonium ethoxylate (15) bisulfate (Quaternium-54) wherein the total amount of ethoxylation averages 15 moles of ethylene oxide per mole of quaternary nitrogen, N-methyl-N-oleylammonium ethoxylate(2) wherein there are an average of 2 moles of ethylene oxide per mole of quaternary nitrogen, N-methyl-N-stearylammonium propoxylate(15) bisulfate, wherein there are an average of 15 moles of propylene oxide per quaternary nitrogen, and the like.

The total amount of active cationic surfactant may be from about 3% to about 30% by weight of the total composition. Preferably, for an aqueous liquid detergent composition, the cationic surfactant is present at about 3.5% to about 7% by weight of the composition.

In most preferred practice, both cationic surfactants 1 and 2 are present in the composition. When this is the case, cationic surfactants of the first formula (1) may be present in the composition relative to those selected from the second formula (2) at a molar ratio of about 1:2 to about 8:1, and most preferably at a ratio one to the other, of about 1:1 to about 5:1, respectively.

The anionic portion of the cationic anionic complex consists essentially of a mixture of two water soluble anionic surfactants, surfactants 3 and 4. Surfactant 3 is selected from the group of short chain $C_4$–$C_{10}$ alcohol sulfates, and surfactant 4 is selected from the group of longer chain $C_{12}$–$C_{22}$ alcohol ethylene oxide ether sulfates and carboxylates having about 1–15 moles of ethylene oxide per molecule. These anionic surfactants may be present as their alkali metal or ammonium salts.

Examples of suitable short chain alcohol sulfates, surfactant 3, include sodium 2-ethylhexyl sulfate, sodium decyl sulfate, sodium hexyl sulfate, sodium octyl sulfate, and the the like. Sodium 2-ethylhexyl sulfate is particularly preferred.

Examples of surfactant 4, the longer chain, $C_{12}$–$C_{22}$ alcohol ethoxylated ether sulfate or carboxylate terminated surfactants, include sodium polyoxyethylene (3) myristyl ether sulfate (Sodium Myreth-3 Sulfate), sodium polyoxyethylene (7) or (12) lauryl ether sulfates (Sodium Laureth-7 or -12 Sulfates), sodium sulfated $C_{12}$–$C_{15}$ alcohol ethoxylate having an average of 3 moles of ethylene oxide per molecule (Sodium Pareth-25-3 Sulfate) and sodium polyoxyethylene (6) tridacanol carboxymethyl ether (Sodium Trideceth-7 Carboxylate).

The anionic surfactants of the above two classes must both be present in roughly equal amounts as indicated by a mole ratio, one to the other, of about 1:5 to about 5:1. Preferably, they are present in a molar ratio, one to the other, of about 1:1.5 to about 1.5:1.

The mole ratio of total cationic surfactant to total anionic surfactant is preferably adjusted so that there is a molar excess of cationic surfactant present in the composition. Thus, as stated previously, the preferred cationic-anionic surfactant mole ratio is preferably in the range of about 1.1:1 to about 5:1, and the best cleaning, antistatic and softening effects are achieved by this invention when the most preferred cationic-anionic surfactant mole ratio of about 1.4:1 to about 2.5:1 is utilized.

Long chain tertiary amine oxides may also be present in compositions of this invention. Although sometimes stated in the art to possess cationic character, the tertiary amine oxides do not appear to assist in reducing static or in softening the fabrics in this invention, as is typical for cationic surfactants. These amine oxides do assist in maintaining the physical stability of the liquid products of this invention and their presence tends to improve the overall detergency or soil removal of the compositions. Examples of suitable long chain tertiary amine oxides include cocoamidopropylamine oxide, coco dihydroxyethyl amine oxide, dihydroxyethyl cocoamine oxide, tallow dimethylamine oxide, cocomorpholine oxide, and the like.

The long chain tertiary amine oxides may be present in the composition relative to the nonionic surfactant at a ratio by weight of about 1:15 to about 3:1, respectively. Preferably, the ratio of the long chain tertiary amine oxide to the nonionic surfactant is from about 1:10 to about 1:4.

While pH is of secondary significance herein, the compositions according to this invention are preferably formulated at a pH value of about 7 to about 10. Suitable materials for adjusting the pH of these compositions include triethanolamine, diethanolamine, sodium carbonate, sodium bicarbonate, and the like. Additionally, brighteners, detergent builders, dyes, fragrances and the like may be included in the compositions.

The compositions of this invention may be prepared for commercially useful products at a total active level of nonionic, cationic and anionic surfactants of about 8% to about 80% by weight solids. The lower value being useful as an aqueous liquid detergent suitable for washing a typical 6–8 lb. wash load at a use level of about one cup, while a product formulation at the higher value may be used for a similar wash load at about a 1/10–1/8 cup use level.

Preferably, the compositions of this invention are formulated in aqueous medium at a nonionic, cationic and anionic surfactant total concentration of about 8% to about 20% by weight of the composition. Compositions formulated at these concentrations are particularly effective at a use level of about ½ cup per 6–8 lb. wash load. These preferred compositions are clear, and there is no evidence of precipitate formation or clouding on aging.

Compositions of this invention are also clear when formulated to contain up to about 80% by weight total nonionic, cationic and anionic surfactants. At these high concentrations, these compositions are, in essence, anhydrous, in that while minor amounts of water may be present (up to about 10% by weight) due to its presence in some of the ingredients, water need not be added during formulation to achieve a homogeneous, clear, effective composition.

To prepare the preferred aqueous compositions, the water is first added to the mixing vessel followed by the nonionic surfactant, the mixture of anionic surfactants, and then the cationic surfactant. This is in contradiction to the teachings of Canadian Pat. No. 818,419. The composition is preferably mixed continually as it is formed, with each component being thoroughly mixed in prior to the addition of the next component.

The compositions of this invention may be prepared at ambient temperature, although moderate heating near about 110° F. hastens the achievement of thorough admixture into the composition after the addition of each component. The various components of the composition are preferably themselves liquids, and those which are solids at ambient temperature, such as Nonoxynol-20, may be warmed to melt them prior to their addition to the composition.

If additional ingredients such as the long chain tertiary amine oxide, brightener, dye and fragrance are used, they may be added to the composition at any convenient time. Preferably, these materials are added after the nonionic surfactant. If the composition is heated during its manufacture, the fragrance is preferably added last and near ambient temperature to minimize its volatilizaion.

BEST MODES FOR CARRYING OUT THE INVENTION

Example 1.

Prior Art Composition 1—Granule

A granular detergent composition was prepared according to Examples I and III of Canadian Pat. No. 814,419 and contained the following materials:

| Charge | Parts by Weight (Active) |
|---|---|
| Electro-Neutral Complex | |
| Dihydrogenated tallow dimethyl ammonium chloride | 2.25 |
| Sodium dodecyl benzene sulfonate | 1.34 |
| Dispersing Agent | |
| Pareth-15-7 (Note 1) | 7.00 |
| Auxiliary Materials | |
| Fragrance | 0.05 |
| Sodium tripolyphosphate | 40.00 |
| Sodium metasilicate . $5H_2O$ | 5.00 |
| Borax . $5H_2O$ | 1.00 |
| Sodium carboxymethyl cellulose | 1.00 |
| Sodium carbonate | 41.37 |
| | 99.01 (Note 2) |

Note 1
The material sold by Union Carbide Corporation under the trademark name Tergitol 15-S-7 was used.
Note 2
The sodium dodecyl benzene sulfonate was only 85% active as used in said patent example, and herein. However, the data herein are reported as parts of active material.

After mixing the above ingredients as per said patent's instructions of Example I, an additional 1% by weight of the composition of dihydrogenated tallow dimethyl ammonium chloride was admixed therein, in place of distearyldimethyl ammonium chloride, as per Example III of said patent. This additional amount of cationic species provides the cationic excess called for in said patent.

Example 2:

Prior Art Composition 2—Liquid

An aqueous liquid detergent similar to the granular composition of Example 1, herein, was prepared following the teachings of Canadian Pat. No. 814,419. The concentrations of the various ingredients were adjusted upwards so that when used at ½ cup per 6–8 lb. wash load, the amount of active ingredients would be comparable to the amount in the granular composition of Example 1 herein, when that granular composition was used for a 6–8 lb. wash load. This composition contained the following ingredients:

| Charge | Parts by Weight (Active) |
|---|---|
| Electro-Neutral Complex | |
| Dihydrogenated tallow dimethyl ammonium chloride | 5.45 |
| Sodium dodecyl benzene sulfonate | 2.975 |
| Dispersing Agent | |
| Note 1 | 14.00 |
| Solvents | |
| Isopropanol | 20.00 |
| Water | 57.07 |
| | 99.475 (Note 2) |

This aqueous liquid detergent composition was unstable and formed a precipitate on standing. It was used for testing not withstanding the precipitate, and was shaken before use to disperse the precipitate as evenly as possible.

Example 3:

Prior Art Composition 3—Granule

A granular detergent composition was prepared according to Example 9, Table IX of U.S. Pat. No. 4,058,489, with the exceptions noted, by mixing the following:

| Charge | Parts by Weight (Active) |
|---|---|
| Ditallow dimethyl ammonium chloride | 2.60 |
| Alkyl polyglycol ether sulfate (Note 3) | 1.74 |
| Nonionic surfactant (Note 4) | 9.00 |
| Sodium tripolyphosphate | 30.00 |
| Sodium sulfate | 25.00 |
| $Na_2B_2O_6 . 8H_2O$ | 20.00 |
| $Na_2O . 2 . 4 . SiO_2$ (3.3 $SiO_2$ National) | 8.00 |
| Sodium Carboxymethyl cellulose | 2.00 |
| Water | 0.50 |
| | 98.84 (Note 3) |

Note 3.
A 60% active surfactant was used and accounts for the difference of 1.16 parts from 100% in the activity of the composition. This surfactant has a higher molecular weight than the material designated in said example and was used at an active level of 1.74 parts to maintain the charge ratio stated in said patent.
Note 4.
Pareth-15-7 was again used as the nonionic surfactant as the nonionic suggested could not be obtained.

Example 4:

Cationic Aqueous Liquid Laundry Detergent And Fabric Softener

A cationic aqueous liquid laundry detergent and fabric softener according to this invention was prepared as follows:

| | Charge | Parts By Weight (As Is) | Parts By Weight (Active) |
|---|---|---|---|
| (1) | Water (soft) | 78.850 | |
| (2) | Nonionic surfactant (Note 5) | 5.000 | 5.000 |
| (3) | Brightener | 0.300 | 0.300 |
| (4) | $C_4$–$C_{10}$ alcohol sulfate (Note 6) | 1.900 | 0.760 |
| (5) | Ethoxylated $C_{12}$–$C_{22}$ alcohol ether sulfate (Note 7) | 1.900 | 1.140 |
| (6) | Triethanolamine | 2.500 | 2.500 |
| (7) | Polyethoxylated quaternary ammonium sulfate (Note 8) | 2.100 | 1.995 |
| (8) | Alkyl Trimethylammonium chloride (Note 9) | 4.000 | 3.000 |
| (9) | Cocoamidopropyldimethylamine oxide | 2.500 | 0.750 |
| (10) | Water (soft) | 0.792 | 0.792 |
| (11) | Dye (in ethanol) | 0.008 | 0.008 |
| (12) | Perfume | 0.150 | 0.150 |
| | | 100.000 | |

Note 5.
Nonoxynol-8 was used.
Note 6.
Sodium 2-ethylhexyl sulfate was used.
Note 7.
Sodium ethoxylated $C_{12}$–$C_{15}$ fatty alcohol sulfate having an average of 3 moles of ethylene oxide per mole of alcohol was used (Sodium Pareth-25-3 Sulfate).
Note 8.
N-ethyl-N-cocoammonium ethoxylate (15) sulfate was used.
Note 9.
Tallow trimethylammonium chloride was used.

The above components were mixed in the order they are listed hereinabove at ambient temperature. The composition was agitated until it appeared to be homogeneous after each of the components was added, and before the next component was added. The final composition was clear with no evidence of precipitate formation or clouding when aged. This composition is useful at about ½ cup per 6–8 lb. wash load.

Example 5:

Comparisons

The compositions of Examples 1–4 and a commercial liquid detergent without softening or antistatic additives were compared for their detergency or ability to remove soil in water having 140 p.p.m. and 300 p.p.m. of hardness using four types of fabrics (permanent press, cotton, polyester and nylon) in a laboratory Terg-O-Tometer type washing machine, and the detergency values over these eight variables averaged. The fabrics were dirtied with Spangler artificial soil and an artificial soil of our making (soil #2) containing Bandy black clay and Triolein. The detergency for the commercial composition was arbitrarily set at 100.0.

Label directions were followed for the commercial product's usage amounts, while the amounts suggested for use in the above-mentioned patents were used for the compositions prepared in accordance therewith. The composition of this invention, Example 4, was formulated for use at about ½ cup per 6–8 lb. wash load, and a proportional amount was used for these tests.

Tests were also run comparing some of these five compositions for their fabric softening properties. In these tests, panels determined softness subjectively, by fabric touch, and then rated the softness of the fabrics washed in each of the compositions, one to the others, using an arbitrary scale.

Another test determined antistatic properties. Here, a trained operator rated cloths washed in the compositions of the above examples from 4 to 0, with 0 being static free and 4 being the poorest score.

All subjective evaluations were done blind. Thus, the evaluators did not know which product they were testing.

The results of the above comparisons are shown in Table 1 below.

TABLE 1

| Composition of Example | Test Results 1 | 2 | 3 | 4 | Comm. Prod. |
|---|---|---|---|---|---|
| Detergency | | | | | |
| (a) Spangler soil | 97.1 | 68.9 | 109.9 | 127.2 | 100.0 |
| (b) Soil #2 | 76.6 | 25.1 | 72.9 | 105.5 | 100.0 |
| Static | 3 | 4 | 4 | 2* | 4* |
| Softness Ratings | | | | | |
| Test 1 | 83.5 | 56.5 | 7.0 | — | — |
| Test 2 | 74.0 | — | — | 37.5 | 6.0 |

*These values are from a separate experiment run at 48% relative humidity while the other three values were obtained at 38% relative humidity.

Example 6:

High Solids Cationic Liquid Detergent and Fabric Softener

A high solids cationic liquid laundry detergent and fabric softener having no added water was prepared as follows using the ingredients of Example 4:

| | Charge | Parts By Weight (As Is) | Parts By Weight (Active) |
|---|---|---|---|
| (1) | Nonionic detergent | 25.00 | 25.00 |
| (2) | Brightener | 1.50 | 1.50 |
| (3) | $C_4$-$C_{10}$ alcohol sulfate | 9.00 | 3.60 |
| (4) | Ethoxylated $C_{12}$-$C_{22}$ alcohol sulfate | 9.40 | 5.40 |
| (5) | Triethanolamine | 12.50 | 12.50 |
| (6) | Polyethoxylated quaternary ammonium sulfate | 10.00 | 9.50 |
| (7) | Alkyl trimethylammonium chloride | 19.00 | 14.25 |
| (8) | Long chain tertiary amine oxide | 12.50 | 3.75 |
| (9) | Dye (in ethanol) | 1.10 | |
| (10) | Fragrance | 0.40 | |
| | | 100.00 | |

The above components were admixed at ambient temperature in the order mentioned hereinabove. The composition was continually agitated during admixture with sufficient time between component additions to allow thorough mixing of the previously added component.

The composition of this example, when used at 1/10-⅛ cup on a 6-8 lb. wash load, gave detergency, softness and antistatic results similar to those of the composition of Example 4.

We claim:

1. A cationic liquid laundry detergent composition adapted to soften fabrics and render them antistatic comprising:

(A) about 3-35% by weight nonionic surfactant formed from reacting ethylene oxide and a hydrophobic organic compound containing about 8 to about 50 carbon atoms, said nonionic surfactant containing about 5 to about 200 moles of ethylene oxide per mole of hydrophobe;

(B) about 3-30% by weight of mono-long chain aliphatic cationic surfactant selected from surfactants 1, 2 and mixtures thereof, surfactant 1 having the formula:

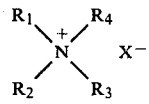

1 wherein $R_1$ is a long chain aliphatic radical having about 8-22 carbon atoms, $R_3$ and $R_4$ are $C_1$—$C_4$ alkyl, $R_2$ is $C_1$—$C_4$ alkyl, benzyl or phenyl, and $X^-$ is an anion, and surfactant 2 having the formula:

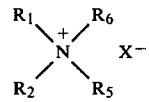

2 wherein $R_1$, $R_2$ and $X^-$ are the same as set forth above,

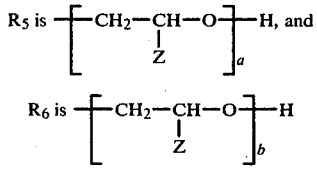

wherein a and b have an average value of at least about 1, a+b is about 2-50, and Z is hydrogen or methyl; and (C) anionic surfactants consisting essentially of a mixture of water soluble surfactants 3 and 4, wherein surfactant 3 is a $C_4$—$C_{10}$ alcohol sulfate, and surfactant 4 is selected from $C_{12}$—$C_{22}$ alcohol ethoxylated ether sulfates and carboxylates having about 1-15 moles of ethylene oxide per molecule, said surfactants 3 and 4 being present in a mole ratio of 1:5 to 5:1, and the cationic-anionic surfactant mole ratio being 0.8:1 to about 10:1.

2. The liquid detergent composition of claim 1, wherein said $R_3$ and $R_4$ of said surfactant 1 are both methyl.

3. The liquid detergent composition of claim 1, wherein said cationic surfactants 1 and 2 are present in admixture with one another at a mole ratio, one to the other in the order listed, of about 1:2 to about 8:1, respectively.

4. The liquid detergent composition of claim 1, wherein said anionic surfactants 3 and 4 are present at a mole ratio, one to the other, of about 1:1.5 to about 1.5:1, respectively.

5. The liquid detergent composition of claim 1, wherein said cationic-anionic surfactant mole ratio is about 1.1:1 to about 5:1.

6. The liquid detergent composition of claim 1, additionally comprising a long chain tertiary amine oxide present relative to said nonionic surfactant at a weight ratio of about 1:15 to 3:1.

7. The liquid detergent composition of claim 6, wherein said cationic-anionic surfactant mole ratio is about 1.4:1 to about 2.5:1.

8. The liquid detergent composition of claim 7, wherein said nonionic, cationic and anionic surfactants comprise about 8% to about 80% by weight of said composition.

9. An aqueous cationic liquid laundry detergent composition adapted to soften fabrics and render them antistatic comprising water containing surfactants in a concentration of about 8% to about 20% by weight of said composition, said surfactants comprising:

(A) nonionic surfactant formed from reacting ethylene oxide and a hydrophobic organic compound containing about 8 to about 50 carbon atoms, said nonionic surfactant containing about 5 to about 200 moles of ethylene oxide per mole of hydrophobe;

(B) a mixture of mono-long chain aliphatic cationic surfactants selected from surfactants 1 and 2, surfactant 1 having the formula:

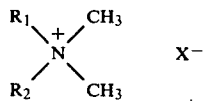

1 wherein $R_1$ is a long chain aliphatic radical having about 8–22 carbon atoms, $R_2$ is $C_1$—$C_4$ alkyl, benzyl or phenyl, and $X^-$ is an anion, surfactant 2 having the formula:

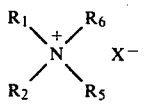

2 wherein $R_1$, $R_2$ and $X^-$ are the same as set forth above,

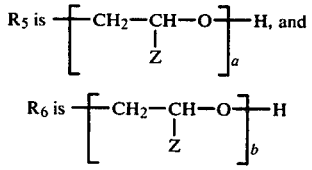

wherein a and b have an average value of at least about 1, a+b is about 2–50 and Z is hydrogen or methyl; and (C) anionic surfactants consisting essentially a mixture of water soluble surfactants 3 and 4, wherein surfactant 3 is a $C_4$–$C_{10}$ alcohol sulfate, and surfactant 4 is selected from $C_{12}$—$C_{22}$ alcohol ethoxylated ether sulfates and carboxylates having about 1–15 moles of ethylene oxide per molecule;

said nonionic and cationic surfactants being present in a weight ratio of from 3:1 to about 1:3, said cationic surfactants 1 and 2 being present at a mole ratio, one to the other in the order listed, of about 1:2 to about 8:1, said anionic surfactants 3 and 4 being present at a mole ratio, one to the other, of about 1:5 to about 5:1, respectively, and the cationic-anionic surfactant mole ratio of said composition being about 1.1:1 to about 5:1.

10. The aqueous laundry detergent composition of claim 9, wherein said cationic surfactants 1 and 2 are present in admixture with one another at a mole ratio, one to the other in the order listed, of about 1:1 to about 5:1.

11. The aqueous laundry detergent composition of claim 10, wherein said anionic surfactants 3 and 4 are present at a mole ratio, one to the other, of about 1.5:1 to about 1:1.5, respectively.

12. The aqueous laundry detergent composition of claim 11, wherein said surfactant 3 is 2-ethylhexyl sulfate.

13. The aqueous laundry detergent composition of claim 9, wherein said nonionic surfactant is comprised of octylphenol or nonylphenol ethoxylates having about 6 to about 100 moles of ethylene oxide per molecule.

14. An aqueous cationic liquid laundry detergent composition adapted to soften fabrics and render them antistatic comprising:

water having admixed therein a total of about 8% to about 20% nonionic, cationic and anionic surfactants by weight solids of the compositions;

said nonionic surfactants being present at about 3% to about 10% by weight of the composition and comprising octylphenol or nonylphenol ethoxylates having about 6 to about 100 moles of ethylene oxide per molecule;

said cationic surfactants being present at about 3.5% to about 7% by weight of the active ingredients as a mixture of mono-long chain aliphatic cationic surfactants selected from surfactants 1 and 2, surfactant 1 having the formula:

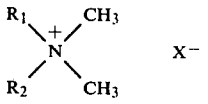

1 wherein $R_1$ is a long chain aliphatic radical having about 8–22 carbon atoms, $R_2$ is $C_1$—$C_4$ alkyl, benzyl or phenyl, and $X^-$ is an anion, surfactant 2 having the formula:

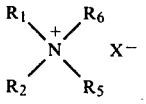

2 wherein $R_1$, $R_2$ and $X^-$ are the same as set forth above,

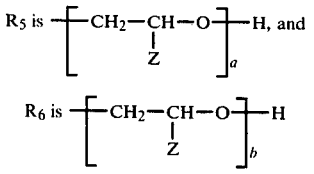

wherein a and b have an average value of at least about 1, a+b is about 2–50, and Z is hydrogen or methyl; and said anionic surfactants consist of essentially of a mixture of anionic surfactants 3 and 4, wherein surfactant 3 is 2-ethylhexyl sulfate, and surfactant 4 is selected from $C_{10}$—$C_{22}$ alcohol ethoxylated ether sulfates and carboxylates having about 1–15 moles of ethylene oxide per molecule;

said cationic surfactants 1 and 2 being present at a mole ratio, one to the other in the order listed, of about 1:1 to about 5:1, said anionic surfactants 3 and 4 being present at a mole ratio, one to the other, of about 1:1.5 to about 1.5:1, and the cationic-anionic surfactant mole ratio of said composition being about 1.4:1 to about 2.5:1.

15. The aqueous laundry detergent composition of claim 14 wherein said anion $X^-$ is selected from the group consisting of halide, sulfate, methyl sulfate and bisulfate ions.

16. The aqueous laundry detergent composition of claim 14, additionally comprising a long chain tertiary amine oxide present relative to said nonionic surfactant at a weight ratio of about 1:10 to about 1:4.

* * * * *